United States Patent [19]

Greene et al.

[11] 4,363,716

[45] Dec. 14, 1982

[54] CRACKING OF HEAVY CARBONACEOUS LIQUID FEEDSTOCKS UTILIZING HYDROGEN DONOR SOLVENT

[76] Inventors: Marvin I. Greene, 201 Beechwood Rd., Oradell, N.J. 07649; Abraham P. Gelbein, 45 Headley Rd., Morristown, N.J. 07960

[21] Appl. No.: 238,344

[22] Filed: Feb. 26, 1981

[51] Int. Cl.[3] ..... C10G 49/20; C10G 55/04

[52] U.S. Cl. ..... 208/80; 208/56; 208/57; 208/107

[58] Field of Search ..... 208/56, 57, 107, 80

[56] References Cited

U.S. PATENT DOCUMENTS

| | | | |
|---|---|---|---|
| 3,336,411 | 8/1967 | Benham | 585/480 X |
| 3,504,045 | 3/1970 | Scharf et al. | 585/480 X |
| 3,533,936 | 10/1970 | Weisz et al. | 208/56 |
| 3,775,498 | 11/1973 | Thompson | 585/484 X |
| 4,115,246 | 9/1978 | Sweany | 208/56 |
| 4,163,707 | 8/1979 | Goudriaan et al. | 208/56 X |
| 4,213,846 | 7/1980 | Sooter et al. | 208/56 X |
| 4,294,686 | 10/1981 | Fisher et al. | 208/56 |

*Primary Examiner*—Delbert E. Gantz
*Assistant Examiner*—G. E. Schmitkons
*Attorney, Agent, or Firm*—Marvin Bressler

[57] ABSTRACT

Heavy carbonaceous liquid having a melting point below 250° C. is upgraded to lighter products by hydrogen donor solvent cracking, using recycled solvent derived at least in part from a middle distillate fraction of either the heavy carbonaceous liquid or from the cracked products which is subjected to one or more catalytic hydroprocessing steps before recycling.

7 Claims, 2 Drawing Figures

Figure 1:
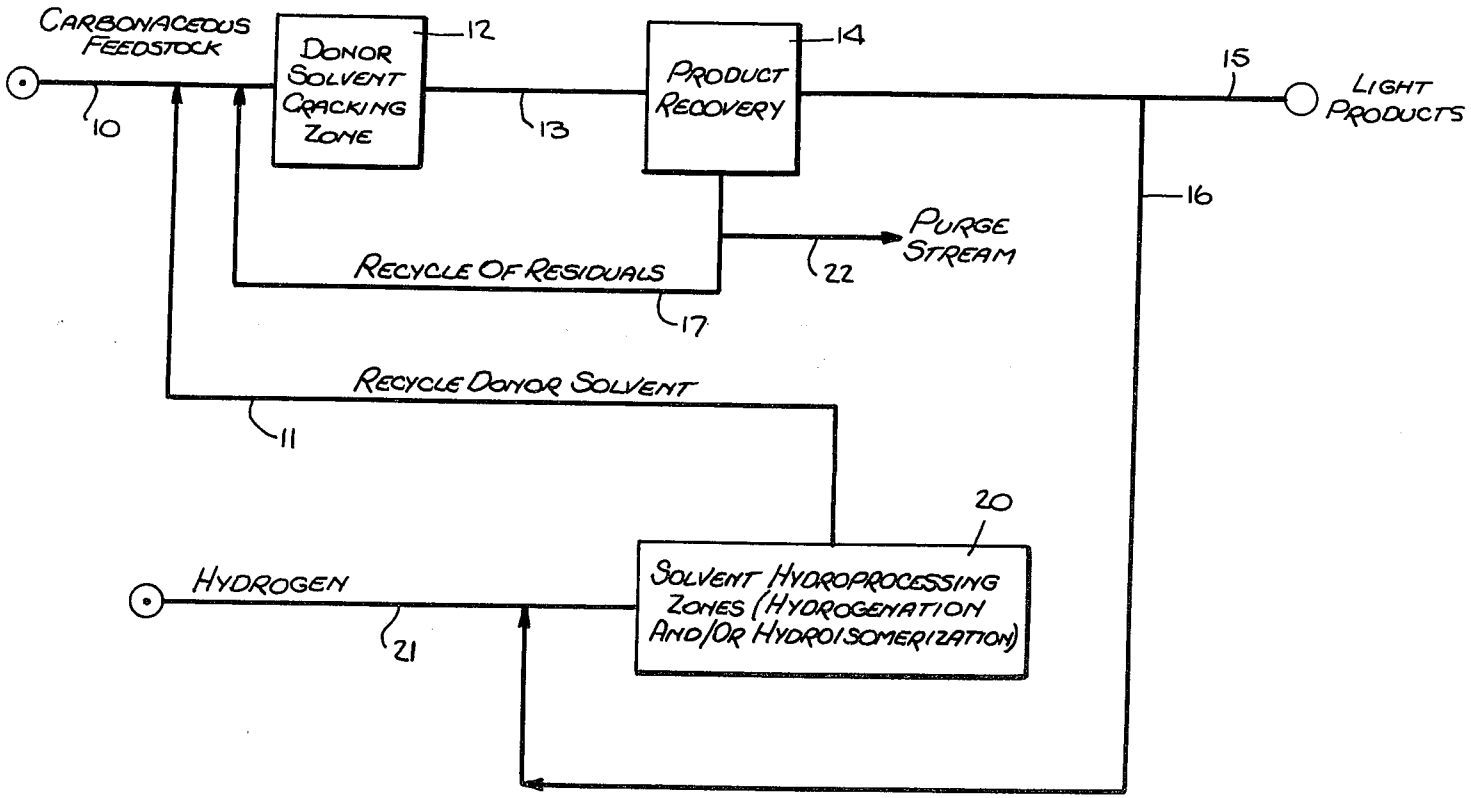

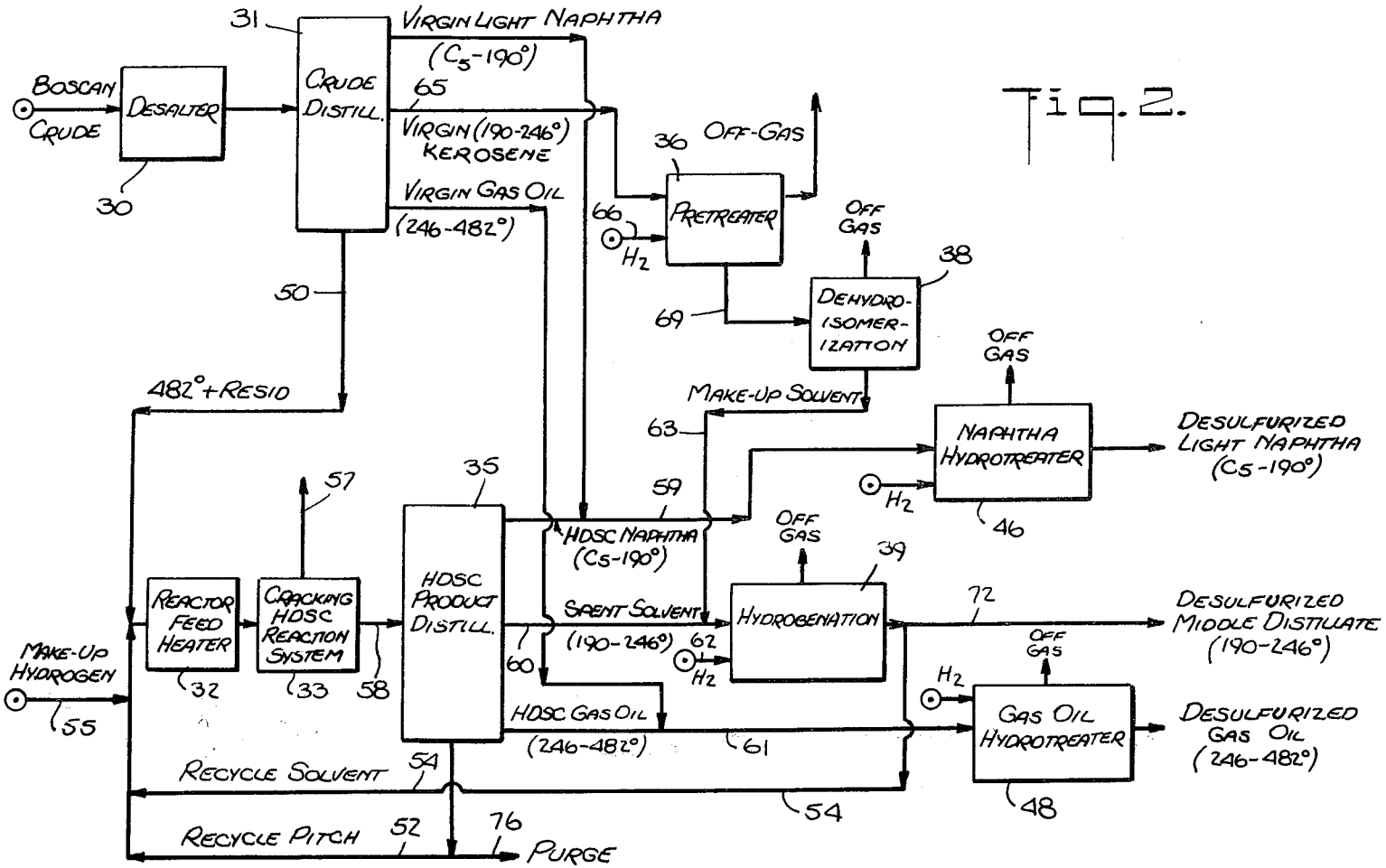
Fig. 2.
Boscan Crude
Desalter
30
Crude Distill.
31
Virgin Light Naphtha (C5-190°)
65
Virgin (190-246°) Kerosene
Virgin Gas Oil (246-482°)
Off-Gas
Pretreater
36
66
H2
69
Dehydro-isomer-ization
38
Off Gas
Make-Up Solvent
63
50
482°+Resid
Reactor Feed Heater
32
Cracking HDSC Reaction System
33
57
58
HDSC Product Distill.
35
HDSC Naphtha (C5-190°)
59
Spent Solvent (190-246°)
60
HDSC Gas Oil (246-482°)
Hydrogenation
39
62
61
Off Gas
Naphtha Hydrotreater
46
Desulfurized Light Naphtha (C5-190°)
Desulfurized Middle Distillate (190-246°)
72
Gas Oil Hydrotreater
48
Desulfurized Gas Oil (246-482°)
54
Make-Up Hydrogen
55
Recycle Solvent
Recycle Pitch
52
Purge
76

CRACKING OF HEAVY CARBONACEOUS LIQUID FEEDSTOCKS UTILIZING HYDROGEN DONOR SOLVENT

This invention relates to an integrated process for cracking heavy carbonaceous liquid feedstocks using hydrogen donor solvent derived from the feedstock.

The invention is concerned with a hydrogen donor solvent cracking process for upgrading heavy carbonaceous liquid feedstock (especially crude petroleum or a high boiling fraction or heavy residue derived from crude petroleum) to valuable lighter products (especially products useful as feedstock to conventional petroleum refineries). In one aspect, the invention is concerned with employing, as the hydrogen donor solvent, a fraction of the cracked products which is subjected to one or more external hydroprocessing steps (selective hydrogenation and/or hydroisomerization) before being recycled to the cracking stage. In another aspect, the invention provides an integrated process in which the recycle solvent is supplemented by a makeup stream derived from the feedstock which undergoes dehydroisomerization before being added to the recycle stream for further hydroprocessing. Still another aspect of the invention involves carrying out a hydrogen donor solvent cracking step under conditions of unusually short residence times combined with unusually high temperatures.

The invention will be described with reference to the accompanying drawings, wherein:

FIG. 1 is a diagrammatic representation of one form of the process of the invention; and, FIG. 2 is a flow diagram representing a modification of the invention.

The feedstocks employed in the invention include, but are not limited to, such materials as the following:

1. Petroleum crude oil—full range;
2. Atmospheric residuum having a 316° C. (atmospheric equivalent temperature) or higher initial boiling point;
3. Vacuum residuum having a 427° C. (atmospheric equivalent temperature) or higher initial boiling point;
4. Fluid catalytic cracking, heavy cycle oils;
5. Delayed or fluid coker recycle oils;
6. Heavy visbreaker bottoms; and
7. Heavy steam cracker bottoms.

All of the foregoing carbonaceous feedstocks are liquids at elevated temperatures (about 100°–250° C.).

The invention comprises in serial combination the steps of:

(a) adding a stream of hydrogen-donating material, obtained as stated hereinafter, and heavy carbonaceous feedstock, in weight ratio of at least 0.25 part of hydrogen-donating material per part by weight of heavy carbonaceous feedstock, to a cracking reaction zone;

(b) heating the reaction mixture resulting from step (a) in said zone at a temperature of at least 250° C. but less than 800° C. for a total residence time at the specified temperature of from 15 seconds to 5 hours;

(c) removing the products from the reaction zone and recovering a middle distillate fraction boiling in the range of 175° C. to 300° C. atmospheric equivalent temperature;

(d) subjecting said middle distillate fraction to one or more external hydroprocessing steps in zones containing hydrogen and catalyst thereby adding hydrogen to obtain a hydrogen-donating material containing at least 30% by weight of 2-ring hydroaromatics having 10 to 20 carbon atoms per molecule;

(e) recycling said hydrogen-donating material obtained in step (d) to the cracking zone specified in step (a); and (f) recovering hydrogen-enriched desired lighter products from the product of step (b).

In one form of the invention the recycled hydrogen-donating material is derived entirely from the described middle distillate fraction of the cracked products by selective hydrogenation in step (d) in the presence of molecular hydrogen and a solid base metal catalyst such as nickel-molybdenum, cobalt-molybdenum and nickel-tungsten supported on alumina or silica-alumina and the like.

In another form of the invention the recycled hydrogen-donating material is further subjected to hydroisomerization in step (d), using a solid acidic hydroisomerization catalyst such as silica-alumina, phosphoric acid on kieselguhr, silica-magnesia, silica-alumina-zirconia, acidic crystalline zeolites and the like.

In a preferred form of the invention the recycle stream is supplemented by a makeup stream of middle distillate material derived from the heavy carbonaceous feedstock which is first passed through a dehydroisomerization zone in the presence of molecular hydrogen and any suitable non-noble or noble metal reforming catalyst such as chromia-alumina, molybdenum-alumina, platinum-alumina and the like, after which the thus-dehydroisomerized makeup stream is passed into the hydrogenation step (d) along with the recovered middle distillate stream from step (c). In step (d), the combined recovered recycle stream from step (c) and the dehydroisomerized makeup stream are together subjected to selective hydrogenation in the presence of molecular hydrogen and a conventional base metal catalyst to provide the total replenished (i.e., hydrogen-rich) hydrogen donor solvent stream returned to the cracking zone in step (e).

As indicated, the dehydroisomerization of the makeup stream may be effected with a noble metal catalyst, in which case the makeup stream must be catalytically desulfurized and denitrogenated to very low levels of sulfur and nitrogen compounds prior to dehydroisomerization. Alternately, the dehydroisomerization can be effected using a sulfur-resistant reforming catalyst such as chromia-alumina or the preferred molybdena-alumina. In either case, the dehydroisomerized makeup component and the recycle component are combined and then selectively hydrogenated over conventional base-metal catalyst in step (d).

The purpose of hydroprocessing the 175°–300° C. fraction of the cracked products (i.e., the recycle solvent) in step (d) is to convert such fraction into a form in which it is a highly effective hydrogen donor solvent. As initially separated from the cracked products, this 175°–300° C. solvent fraction is high in $C_{10}$+hydrocarbons of aromatic, paraffinic or naphthenic structure but is low in hydroaromatics. Hydroprocessing of this fraction in step (d) converts it into a material rich in 2-ring hydroaromatics and 2-ring hydroalkylaromatics. Thus, the invention provides the desired efficient hydrogen donor solvent in a convenient and economical manner.

It is especially desirable that the recycled solvent contain at least 30% by weight of 2-ring hydroaromatics having 10 to 20 carbon atoms per molecule, as indicated. In some cases, depending on the particular composition of the 175°-300° C. fraction as initially separated from the cracked products, selective hydrogenation with a solid base metal catalyst in step (d) may be sufficient to provide the desired 30% hydroaromatic content. In other cases, selective hydrogenation with a base metal catalyst may be insufficient to bring the content of desired hydroaromatics up to at least 30%, in which case the hydroprocessing step (d) may further include hydroisomerization using a solid acidic catalyst, as indicated, to provide in the recycled solvent at least 30% by weight of 2-ring hydroaromatics having 10 to 20 carbon atoms per molecule.

The form of the invention wherein the recycle solvent is supplemented by a small amount of middle distillate material as makeup solvent represents the preferred, integrated form of the process. The purpose of the dehydroisomerization is to convert the middle distillate makeup material into a form having a composition similar to that of the recycle solvent as recovered from the cracking step, after which the dehydroisomerized middle distillate makeup and the recycle solvent are together subjected to selective hydrogenation with a base metal catalyst as described, to provide the desired hydrogen donor solvent stream for return to the cracking zone.

As indicated, the cracking step (b) is carried out at a temperature of 250°-800° C. for 15 seconds-5 hours. One form of the invention involves carrying out the cracking step at a temperature of at least 250° C. but not greater than 475° C. for a total residence time at the stated temperature of from 10 minutes to 5 hours. Another practice, which is highly desirable from the standpoint of minimizing the cracking reactor volume, is to employ very short residence times in combination with reaction temperatures at the high end of the broad range stated above. In this preferred practice the cracking zone (b) is maintained at a temperature of at least 475° C. (preferably at least 500° C.) but less than 800° C. for a total residence time at the specified temperature of from 15 seconds to 10 minutes (preferably not more than 5 minutes). These novel reaction conditions give high liquids selectivity and low coke selectivity. We have found that the initial rate of cracking reactions, i.e., at residence times below 15 minutes, is fast and the rate increases exponentially with temperature. At longer residence times initial cracked hydrocarbon products will undergo secondary decomposition reactions leading to excessive coke and gas formation. Thus at higher temperature (about 475°-800° C.) and shorter residence times (about ¼-10 minutes) the preferred present cracking process results in high conversion rates without high coke and gas selectivities that are normally observed in conventional longer residence time processes.

While the use of hydrogen donor solvent cracking is known to the art, it is limited to either producing hydrogen donor solvents boiling above 370° C. by (i) use of conventional hydrogenation catalysts for adding hydrogen to convert aromatics to hydroaromatics or (ii) by providing an external source of hydroaromatic donor solvents. The present invention uses a selective hydrogenation zone in which $C_{10}+$ hydrocarbons derived either from the feedstock or from the cracked products, boiling in the range of 175° to 300° C., are hydrogenated in the presence of hydrogen to produce a donor solvent stream rich in 2-ring hydroaromatics and 2-ring hydroalkylaromatics. As indicated, a preferred practice of the invention involves supplementing donor solvent recovered from the cracked products, with additional makeup material derived from the feedstock which is first dehydroisomerized, and then selectively hydrogenated (along with the solvent recovered from the cracking step), for recycling to the cracking step. The lighter donor solvent stream boiling in the range of 175° to 300° C. has more available hydrogen per weight than the heavier state-of-the-art solvents.

The invention is particularly directed to the use of donor solvent which is (1) based on high (in excess of 30% by weight) content of 2-ring hydroaromatic derivatives which generally boil between 175° and 300° C. and (2) readily produced from subject feedstock fractions containing $C_{10}$-$C_{13}$ hydrocarbons by external catalytic dehydroisomerization followed by selective hydrogenation technology thereby rendering the overall process in material balance.

U.S. Pat. No. 2,953,513, Langer, Sept. 20, 1960, employs heavier solvents in contrast to the lighter solvents employed herein. Heavier solvents are not native to the subject feedstocks in concentrations required to render them active as hydrogen donors. The key lighter solvents employed in the present invention, however, can be readily produced in sufficient concentration by various catalytic hydroprocessing technologies from hydrocarbon species that are native to the subject feedstocks. The key components in Langer's disclosure are native to Langer's feedstocks but cannot be readily produced from other hydrocarbon species. The key components in the present donor solvent are tetralin, alkyltetralins, dihydronaphthalene and dihydroalkylnaphthalenes which can be produced by hydroisomerization or dehydroisomerization plus selective hydrogenation of $C_{10}$-$C_{14}$ hydrocarbons which boil in the 175°-300° C. range and are present in the subject feedstock.

U.S. Pat. No. 4,051,012, Plumlee, Sept. 27, 1977, discloses a process specific to coal feedstocks in which there is a positive synergism between a quinone catalyst and oxygenated species that exist in coal-derived donor solvent. The feedstocks employed in this invention are largely hydrocarbons (i.e., they do not contain any significant amounts of oxygenated species).

U.S. Pat. No. 2,843,530, Langer, July 15, 1958, discloses the use of makeup donor solvent derived from an external source such as tars, cyclic oils and lube oil extracts. This solvent therefore is not internally generated. Although it consists of partially hydrogenated, aromatic-naphthenic (hydroaromatic) compounds, the boiling range of 221°-538° C. excludes naphthalene, a key precursor of the present internally generated solvent.

U.S. Pat. No. 3,867,275, Gleim, Feb. 18, 1975, alludes to the expense and difficulty of obtaining 2-ring aromatic solvents. The present invention provides an inexpensive and convenient method of making said 2-ring aromatics for use as donor solvent.

Gorin et al, Proc. 8th World Pet. Congress, Preprints Session No. PD10(5), 44(1971), discloses solvent in which the aromaticity is very high because it is derived from a coal feedstock. The present solvent has more paraffins and naphthenes and lower aromaticity.

Also representative of the state of the art are U.S. Pat. Nos. 3,849,287, Gleim, Nov. 19, 1974; 3,336,411, Benham, Aug. 15, 1967; 3,775,498, Thompson, Nov. 27, 1973; 2,585,899, Langlois, Feb. 12, 1952; 3,504,045, Scharf, Mar. 31, 1970; and 4,176,046, McConaghy, Nov. 27, 1979; Doyle "Desulfurization Via Hydrogen Donor Reactions" Division of Petroleum Chemistry, ACS, Chicago Meeting, Aug. 24–29, 1975, p 165; Neavel "Liquefaction of Coal in Hydrogen-Donor and Non-Donor Vehicles", Fuel, 1976, Vol 55, July, p. 237; Carlson, "Thermal Hydrogenation" Ind. & Eng. Chem. Vol. 50, No. 7, p. 1067; "Aromatic Hydrocarbons'-'—pgs. 230–236, Production and Separation of Alkylnaphthalenes, Marshall Sittig, Editor, 1976, Noyes Data Corp., Park Ridge, N.J.

Referring to FIG. 1 of the drawings, the invention is accordingly concerned with an integrated process for upgrading a heavy carbonaceous feedstream 10, in particular, heavy petroleum crudes, utilizing a hydrogen donor solvent stream 11 to non-catalytically hydrocrack the high boiling materials, in a cracking zone 12 (step (b), above) to a lighter products stream 13.

The cracked product stream 13 is separated, in a product recovery unit 14, into a desired light products stream 15 which is removed from the system, a spent donor solvent stream 16 boiling in the 175°–300° C. range which is treated as hereinafter indicated before recycling, and a heavier residual recycle stream 17 which may be returned directly to the cracking zone 12 to go through the cycle one again or may be purged as stream 22.

The spent donor solvent stream 16 recovered from the reaction products is partially depleted of hydrogen as a result of the donor solvent cracking reactions. The present invention utilizes a hydroprocessing zone 20 in which $C_{10}$+hydrocarbons are selectively hydrogenated in the presence of hydrogen (stream 21) over either base metal hydrogenation catalysts or over solid acidic hydroisomerization catalysts, to produce the replenished donor solvent stream 11 rich in 2-ring hydroaromatics and 2-ring hydroalkylaromatics, such as tetralin and alkyltetralins, thus providing a replenished recycle hydrogen donor stream 11 which is returned (step (e)) to the cracking zone 12.

As indicated, the weight ratio of hydrogen donating material to heavy carbonaceous feedstock is usually at least 0.25 part of hydrogen donating material per part by weight of heavy carbonaceous feedstock. The reaction mixture is either heated in the cracking zone at a temperature within the range of 250° to 475° C. for a residence time of 10 minutes to 5 hours or more preferably is heated at a higher temperature (475°–800° C.) for a shorter residence time (15 seconds-10 minutes). In the hydroisomerization zone the temperature is frequently 200° to 450° C., residence time 10 minutes to 4 hours. Usually 0.05 to 0.40 parts by weight of molecular hydrogen are fed to the hydroprocessing zones, per part by weight of depleted hydrogen donor solvent. The process is suitably carried out at elevated pressure, e.g., from 250 to 1500 psig or higher in the cracking zone and up to 500 psig or higher in the hydroprocessing zones. The hydroprocessing zones may for example take the form of fixed bed or fluid bed tubular reactors.

The following table indicates typical change in composition of the donor solvent in the course of the hydroisomerization step (d) in the isomerization zone 20 under the influence of a solid acidic catalyst:

| Typical Composition, wt. % | Solvent Entering Step (d) | Solvent Leaving Step (d) |
|---|---|---|
| $C_{10}$–$C_{12}$ Tetralins | 18 | 60 |
| $C_{10}$–$C_{12}$ Naphthalenes | 25 | 11 |

-continued

| Typical Composition, wt. % | Solvent Entering Step (d) | Solvent Leaving Step (d) |
|---|---|---|
| $C_{10}$–$C_{14}$ Paraffins | 17 | 11 |
| $C_{10}$–$C_{14}$ Naphthenes | 20 | 11 |
| $C_{10}$–$C_{14}$ Alkylbenzenes | 20 | 7 |

Thus, the hydrogen-depleted solvent as initially separated from the cracked products is low in tetralins and high in naphthalenes and alkylbenzenes, whereas the replenished hydrogenated solvent suitable for recycling to the cracking step is high in tetralins and low in naphthalenes and alkylbenzenes.

As indicated, a preferred form of the invention involves supplementing the replenished recycle hydrogen donor solvent with makeup material derived from the feedstock. This embodiment of the invention is represented in FIG. 2 of the drawings and involves supplementing the recycled solvent with makeup material derived from the feedstock which undergoes dehydroisomerization as described. In more detail, and referring to FIG. 2, one suitable arrangement of apparatus for practicing this form of the invention includes a crude desalter 30, a crude distillation unit 31, a reactor feed heater 32, an HDSC ("HDSC" stands for hydrogen donor solvent cracking) reaction system 33, an HDSC product distillation unit 35, a pretreater 36, a dehydroisomerizer 38, a selective hydrogenation zone 39, a naphtha hydrotreater 46 and a gas oil hydrotreater 48.

In the initial step, a fresh stream 50 of residum to be cracked (derived from the crude distillation unit 31), a stream 52 of recycle pitch to be cracked (derived from the product still 35) and a stream 54 of recycle donor solvent (to be prepared as indicated below) are preheated, in a radiant heater section of the reactor feed heater 32, to the inlet temperature of the HDSC reactor 33. The preheated liquids are now pressurized to 1100 psia. Simultaneously, a fresh hydrogen make-up stream 55 is first preheated against reactor effluent vapor and further heated to reactor inlet temperature in a radiant section of a hydrogen preheater. The preheated and pressurized residuum, donor solvent and molecular hydrogen are now fed to the HDSC zone 33 where feed conversion occurs to form $C_1$–$C_4$ hydrocarbon gases, $C_5$-191° C. light naphthas, 191°–246° C. distillates, 246°–482° C. gas oils, and by-products $H_2S$ and $NH_3$, and pitch.

Flash gases pass off from the HDSC reactor 33 as a HDSC flash gases stream 57, while a liquid products stream 58 passes from the reactor to the HDSC product distillation unit 35, where the products are separated by conventional fractionation technology into a HDSC naphtha stream 59 ($C_5$-190° C. light naphtha), a spent solvent stream 60, a 246°–482° C. HDSC gas oil stream 61, and an unconverted pitch stream 52 recycled to the HDSC reactor 33. The spent solvent stream 60 passes into the selective hydrogenation reactor 39 along with a stream 62 of molecular hydrogen and a makeup solvent stream 63 from the dehydroisomerizer 38.

To supply the dehydroisomerizer 38, a stream 65 of virgin distillate from the crude distillation unit 31 is passed into the pretreater 36 (along with a stream 66 of hydrogen gas) upstream from the dehydroisomerizer 38 where sulfur and nitrogen poisons are removed from the virgin distillate 65 by the action of a heteroatom-removal catalyst. The pretreater may be for example a tubular reactor containing a fixed bed of cobalt-molybdenum-aluminum oxided catalyst or other solid base metal catalyst, operated with a hydrogen flow of 500–5000 SCF/bbl at a temperature of 371°–427° C., a pressure of 1500–2500 psig and 0.5–3.0 LHSV. This removes nitrogen and sulfur to protect the catalyst in the dehydroisomerizer from poisoning. From the pretreater 36 a purified solvent stream 69 is fed to the dehydroisomerizer 38.

It will be understood that in the dehydroisomerization step, $C_{10}$+ hydrocarbons are dehydroisomerized in the presence of hydrogen to produce donor solvent precursors rich in 2 or 3-ring aromatics and 2 or 3-ring alkylaromatics. These donor precursors can then be converted to hydroaromatic-rich donor solvents by selective hydrogenation over conventional base metal catalysts, as indicated above.

Thus, a preferred form of the invention contemplates recovering hydrogen-donating material from the feedstock, in particular the virgin distillate fraction boiling in the range of 175° C. to 325° C. atmospheric equivalent temperature and subjecting said stream to an external dehydroisomerization zone containing molecular hydrogen and any suitable non-noble or noble metal reforming catalyst in such a manner as to obtain a hydrogen-donating precursor material containing at least 40% aromatic content and preferably above 50%, which is recycled to the selective hydrogenation zone where naphthalenes and alkylnaphthalenes are hydrogenated back to the active hydroaromatic state.

The following table illustrates the typical change in composition of the material as a result of treatment in the dehydroisomerizer 38:

| Typical Composition, wt. % | Dehydroisomerizer Feedstock 69 | Dehydroisomerizate 63 |
|---|---|---|
| $C_{10}$–$C_{12}$ Tetralins | 9 | 9 |
| $C_{10}$–$C_{12}$ Naphthalenes | 4 | 62 |
| $C_{10}$–$C_{14}$ Paraffins & Olefins | 33 | 11 |
| $C_{10}$–$C_{13}$ Naphthenes | 37 | 11 |
| $C_{10}$–$C_{13}$ Alkylbenzenes | 17 | 7 |

The dehydroisomerizer is suitably operated at a temperature of 350° to 500° C., under a pressure of 350 to 700 psia; the residence time in the dehydroisomerizer is suitably 0.30 to 2.0 hours. Usually 0.05 to 0.40 parts by weight of molecular hydrogen are fed to the dehydroisomerization zone, per part by weight of makeup solvent. Dehydroisomerization may be carried out in one or more fixed bed tubular reactors or fluid bed reactors, where the virgin distillate stream rich in paraffins, naphthenes and alkylbenzenes is made rich in naphthalenes.

In the process, the dehydroisomerized virgin distillate stream 63 of makeup solvent is combined with spend solvent 60 from the HDSC effluent stream and then selectively hydrogenated in the selective hydrogenation unit 39 to maintain hydrogen donor solvent activity.

The effluent from the selective hydrogenation zone 39 yields a desulfurized middle distillate stream 72, as well as the recycle solvent stream 54 which is returned to the preheater 32 for re-use in the HDSC reaction system 33 as described.

Hydrogen is generated in situ in the process, but additional makeup hydrogen may also be added if desired.

A portion of the pitch from the product distillation unit 35 may be removed from the system as a pitch purge stream 76.

The valuable light naphtha stream 59 (after passing through hydrotreater 46), middle distillate stream 72 and gas oil stream 61 (after passing through hydrotreater 48) represent the desulfurized upgraded products produced by the process.

An example of a feedstock to be processed is a full-range virgin Boscan (from Orinoco belt of Venezuela) crude oil which is desalted and topped to produce a 482° C.+ vacuum resid. The latter is the principal component of the cracking feedstock to the HDSC reactor. In addition, some 482° C.+ pitch is recycled and blended with the virgin resid prior to processing in the HDSC reactor. Typical properties of the full-range crude are as follows:

| | |
|---|---|
| API Gravity | 10.3 |
| Sulfur | 6.1 Wt. % |
| Carbon | 82.88 |
| Hydrogen | 10.44 |
| Nitrogen | 0.58 |
| Vanadium | 1228 ppm |
| Nickel | 117 ppm |
| Conradson Carbon Residue | 15.0% |
| Asphaltenes | 36.6% |
| Vol % Residuum (482° C.+) | 65 |

An example of suitable hydrogen donor solvent cracking zone conditions is as follows:

| | |
|---|---|
| Residence Time, hrs. | 0.50 |
| Pressure, psia | 1000 |
| Average Temperature, °C. | 440 |
| $H_2$ Recycle Rate, SCF/bbl resid | 1000 |
| Solvent/482° C.+ Ratio | 1.0 |
| Pitch/Resid Ratio | 0.5 |

An example of suitable dehydroisomerizer conditions is as follows:

| | |
|---|---|
| Residence Time, hrs. | 0.5 |
| Pressure, psia | 500 |
| Average temperature, °C. | 500 |
| $H_2$ feed rate | 2.7 SCF/bbl |
| Catalyst | Molybdenum-alumina (Katalco Nalform) |

An example of suitable selective hydrogenation conditions is as follows:

| | |
|---|---|
| Residence Time, hrs. | 1.0 |
| Pressure, psia | 500 psi |
| Average temperature, °C. | 300 |
| $H_2$ feed rate | 1.1 SCF/bbl |
| Catalyst | NiMo Alumina (Cyanamid HDS-9A) |

Examples of typical yield and characterizing data for a representative product are as follows:

Yield of Raw Syncrude 0.99 bbl/bbl resid. Yield of desulfurized syncrude is 0.97 bbl per bbl resid when the plant is designed to produce sulfur-free products.

The properties of the typical raw syncrude and the desulfurized syncrude are as follows:

| | Raw Syncrude | Desulfurized Syncrude |
|---|---|---|
| API Gravity | 29 | 35 |
| Sulfur, Wt. % | 3.5 | 0.1 |
| Metals, V + Ni | 0.1 | 0.1 |
| Asphaltenes, Wt. % | 0 | 0 |
| Conradson Carbon Residue, Wt % | 0 | 0 |

What is claimed is:

1. A hydrogen donor solvent cracking process for upgrading heavy carbonaceous liquids having a melting point below 250° C. to lighter products comprising in serial combination the steps of:

(a) adding a stream of hydrogen-donating material, obtained as stated hereinafter, and heavy carbonaceous feedstock in weight ratio of at least 0.25 part of hydrogen-donating material per part of heavy carbonaceous feedstock, to a cracking reaction zone, free of externally-supplied catalyst;

(b) heating the reaction mixture resulting from step (a) in said cracking zone at a temperature of 250° C. to 800° C. for a total residence time at the specified temperature of from 15 seconds to 5 hours to produce hydrogen-enriched cracked products;

(c) removing the resulting products from the cracking reaction zone and recovering therefrom a middle distillate fraction boiling in the range of 175° C. to 300° C. atmospheric equivalent temperature;

(d) subjecting said middle distillate fraction to a selective hydrogenation step in the presence of a solid based metal catalyst thereby adding hydrogen to obtain a replenished hydrogen-donating material richer in hydrogen containing at least 30% by weight of 2-ring hydroaromatics having 10 to 20 carbon atoms per molecule;

(e) hydroisomerizing said replenished hydrogen-donating material in the presence of a solid acidic catalyst;

(f) recycling said hydrogen-donating material obtained in step (d) to the cracking zone specified in step (a); and (g) recovering, from the products produced in said cracking zone, cracked light products boiling below 482° C.

2. The process of claim 1 wherein there is added to the said recycle middle distillate fraction, prior to said hydroprocessing (d), a makeup stream of middle distillate derived from the heavy carbonaceous liquid boiling in the range of 175° to 300° C. which has been dehydroisomerized in the presence of a noble metal catalyst or a sulfur-resistant reforming catalyst to render said makeup stream rich in 2-ring aromatics prior to hydroprocessing in step (d).

3. A method of processing crude petroleum comprising in combination the steps of:

(i) distilling said crude petroleum to provide a virgin middle distillate boiling in the range of 175°-300° C. and a carbonaceous resid which is liquid at 100°-250° C.;

(ii) feeding said resid, molecular hydrogen, and a recycle stream of hydrogen donor solvent to be obtained as hereinafter described to a cracking zone where said materials are heated in the absence of added catalyst at a temperature of 250°-800° C. for a residence time of 15 seconds to 5 hours to produce hydrogen-enriched cracked products;

(iii) distilling the cracked products to provide a solvent fraction boiling at 175°-300° C. for use in preparing recycle solvent;

(iv) subjecting the solvent from step (iii) to hydroprocessing in the presence of molecular hydrogen selected from (A) selective hydrogenation in the presence of a solid base metal catalyst, and (B) hydrogenation in the presence of a solid base metal catalyst followed by hydroisomerization in the presence of a solid acidic catalyst, whereby the content of 2-ring hydroaromatics having 10 to 20 carbon atoms per molecule is increased to at least 30% by weight;

(v) subjecting the said virgin middle distillate from step (i) to dehydroisomerization in the presence of a noble metal catalyst or a sulfur-resistant reforming catalyst to render said virgin middle distillate rich in 2-ring aromatics;

(vi) adding the dehydroisomerized middle distillate from step (v) to the recycle solvent prior to step (iv) as a makeup stream;

(vii) recycling the combined recycle and makeup materials from step (iv) as the hydrogen donor solvent to step (ii); and (viii) recovering from the cracked products from step (ii) hydrogen enriched lighter products.

4. The method of claim 3 wherein the cracking step (ii) is carried out at a temperature of from 250°-475° C. for a residence time of from 10 minutes to 5 hours.

5. The method of claim 3 wherein the cracking step (ii) is carried out at a temperature of from 475° to 800° C. for a residence time of from 15 seconds to 10 minutes.

6. The method of claim 3 wherein a stream of pitch is separated from the cracked products and is recycled to the cracking step (ii).

7. The method of claim 3 wherein the products are recovered in step (vii) by fractional distillation and comprise a light naphtha stream, a middle distillate stream, and a gas oil stream.

* * * * *

UNITED STATES PATENT AND TRADEMARK OFFICE

CERTIFICATE OF CORRECTION

PATENT NO. : 4,363,716

DATED : Dec. 14, 1982

INVENTOR(S) : Marvin I. Greene and Abraham P. Gelbein

It is certified that error appears in the above–identified patent and that said Letters Patent are hereby corrected as shown below:

Column 9 lines 43-44, "material obtained in step(d)" should read as--material obtained in step(e)--.

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*